United States Patent [19]

DiVito et al.

[11] Patent Number: 5,007,803

[45] Date of Patent: Apr. 16, 1991

[54] AIR OPERATED VACUUM PUMP

[75] Inventors: Anthony M. DiVito, Youngstown; Lee H. Giesecke, Warren, both of Ohio

[73] Assignee: Global Pumps, Inc., East Palestine, Ohio

[21] Appl. No.: 414,092

[22] Filed: Sep. 28, 1989

[51] Int. Cl.[5] ..... F04F 1/02

[52] U.S. Cl. ..... 417/137

[58] Field of Search ..... 417/130, 131, 134, 137, 417/138, 143, 144, 145, 146–149, 118, 187, 190

[56] References Cited

U.S. PATENT DOCUMENTS

| | | | |
|---|---|---|---|
| 2,141,427 | 12/1938 | Bryant | 417/485 |
| 3,319,578 | 5/1967 | Ware | 417/148 |
| 3,320,970 | 5/1967 | McHenry | 417/148 |
| 3,932,065 | 1/1976 | Ginsberg et al. | 417/388 |
| 4,108,418 | 8/1978 | Ensign et al. | 137/375 |
| 4,126,040 | 11/1978 | Varacins et al. | 73/293 |
| 4,130,140 | 12/1978 | Cerny et al. | 138/149 |
| 4,583,374 | 4/1986 | Franz et al. | 62/210 |
| 4,630,635 | 12/1986 | Bernstein et al. | 251/5 |
| 4,811,758 | 3/1989 | Piper | 251/5 |
| 4,886,432 | 12/1989 | Kimberlin | 417/478 |

*Primary Examiner*—Leonard E. Smith

*Attorney, Agent, or Firm*—Webb, Burden, Ziesenheim & Webb

[57] ABSTRACT

A compressed air-actuated pump includes a venturi nozzle to create a vacuum condition within a fluid-tight pump body to pump in a liquid or slurry. When a given level of liquid is pumped in, a control circuit closes a flexible sleeve of a pneumatically actuated pinch valve positioned in an exhaust passageway of the venturi nozzle. Upon closing of the pinch valve, the exhaust stream from the venturi nozzle is diverted into the pump body to create a pressurized condition therein whereby the liquid or slurry previously accumulated therein is pumped out. The pump also includes a pair of variable flow control valves for independently adjusting the flow rates of compressed air through the venturi nozzle in the vacuum, pump-in and in the pressurized, pump-out cycles. Solid state opto-electronic liquid level sensors or appropriate pneumatic, electric or electro-pneumatic timing devices are employed to signal the opening and closing of the pinch valve. The flexible sleeve of the pinch valve, as well as all other parts in the pump are constructed of chemically-resistant materials to permit the pumping of erosive, corrosive and abrasive liquids and slurries.

15 Claims, 4 Drawing Sheets

AIR OPERATED VACUUM PUMP

BACKGROUND OF THE INVENTION

The present invention relates generally to pumps for pumping liquid and, more particularly, to pumps operated by compressed air and using an injector or venturi-type nozzle to generate a vacuum therein. Pumps of this type are known, as evidenced by U.S. Pat. No. 2,141,427 to Bryant. Pumps of this type have been utilized heretofore to pump water, for example, and consist of a tank having an inlet and outlet at the bottom with one-way check valves in place at each of the inlet and outlet passageways so as to permit the passage of liquid only in one direction. At the top of the tank, a compressed air nozzle is provided spaced from an outlet exhaust pipe, both of which are placed in communication with the interior of the tank. As high pressure air is injected into the nozzle, a high velocity air stream passes from the nozzle through the exhaust passageway and causes a vacuum condition to exist within the interior of the tank. The vacuum condition causes liquid to be emitted to the tank through the inlet orifice. The one-way check valve positioned in the outlet orifice prevents stored liquid from escaping the tank while the pump is in the vacuum mode of operation. U.S. Pat. No. 2,141,427 discloses the use of a ball-type float valve which rides on the surface of the liquid within the tank. When the liquid reaches a given level within the tank, the float, through appropriate linkage, causes a gate type valve to slide across the air exhaust pipe, shutting off the flow therethrough. When the air flow is so interrupted by the gate valve, the high velocity air exhaust stream is directed downwardly into the tank, causing a positive pressure to exist therein. Consequently, the water contained in the tank is forced out through the outlet orifice at the bottom thereof. In this pressurized pump-down mode, the one-way check valve located in the inlet orifice closes to prevent any water leakage therethrough.

A further vacuum air-driven pump utilizing a venturi style nozzle is disclosed in U.S. Pat. No. 3,320,970 to McHenry. McHenry points out certain operational problems inherent in the aforementioned Bryant pump specifically associated with the operation of the float valve, such as the sticking of the float and the associated mechanical linkage. McHenry proposes an improved valve mechanism which is a liquid level responsive pressure actuator for shifting a spool-type control valve from open to closed positions so as to regulate the pumping cycle of the device. Included in the McHenry sensing system is a rather elaborate array of orifices and fine diameter tubing which render the pump suitable for operation only in very particulate-free, non-corrosive and low viscosity water environments.

The pumps of the prior art, which rely upon means positioned within the liquid accumulator tank for sensing the liquid level or pressure therein and with valve means exposed to the liquid vapors entrained in the exhausting air stream, are not suitable for use in connection with the pumping of corrosive or erosive liquids. Such corrosive liquids quickly attack the sliding metal parts and cause rapid wear and subsequent pump malfunctions. In addition, a shiftable valve spool of the type employed in U.S. Pat. No. 3,320,970 is particularly susceptible to wear caused by abrasive particulate matter present in certain slurries or corrosive vapors present in certain liquids. In addition, it is also apparent that the slidable exhaust valve and linkage of U.S. Pat. No. 2,141,427 is susceptible to abrasive wear and corrosive attack due to the exposure to entrained particulate materials and harmful vapors.

The present invention solves the problems heretofore encountered in the prior art devices for pumping corrosive and erosive liquids and abrasive slurries and the like. The present invention is constructed of corrosion resistant materials and contains no movable or sliding metal parts within the interior of the pump exposed to the liquid or vapors. In this manner, the pump of the present invention is able to withstand the rigors of long exposure to corrosive and erosive slurries, liquids and vapors, as well as solid abrasive particulates, without suffering any appreciable degradation in performance characteristics. The present invention provides a pump which is resistant to corrosive attacks from a wide range of chemical solutions, including acids, alkaline, solvents and others. Our invention provides a compact, compressed air-operated pump for reliable and durable performance having a minimum of moving parts which assures minimum downtime. The pump of the invention is inexpensive to assemble, operate and maintain in the field. The present invention further provides, in one presently preferred embodiment, a pump body constructed of a translucent material which permits visual observation of the pumping cycle while also possessing a very high hoop strength to provide superior pressure resistance.

Still further, the present invention provides a pump in which the pump in cycle and the pump down cycle times can be independently regulated to permit an infinite variety of flow rates. By increasing the pump body size, the liquid storage volume capacity is increased to permit correspondingly greater flow rates. The present invention also performs at comparable flow rates as prior pumps, but with less air consumption, resulting in energy savings for the user.

SUMMARY OF THE INVENTION

Briefly stated, the present invention is directed to a pump apparatus which is particularly suitable for pumping corrosive and erosive liquids, abrasive slurries and the like. The apparatus comprises a fluid-tight pump body for containing the pumped liquid, which preferably is constructed of a translucent filament-wound epoxy material to permit visual observation of the liquid level therein during operation. The pump body has respective inlet and outlet orifices in a lower portion thereof with one-way check valves associated with each of the orifices. An air nozzle, or so-called venturi nozzle, preferably in the form of a converging, diverging design, is positioned in an upper portion of the pump body, adjacent an inlet air passageway. The nozzle is preferably in the form of flanged cylindrical insert which is removably positioned within the air inlet passageway. In this manner, nozzles of various pre-selected throat diameters may be used in the pump device so as to selectively establish any desired vacuum level and flow rate. Spaced from the nozzle, and axially aligned therewith, is an air exhaust passageway, which extends across the top portion of the pump body and communicates with an exhaust end thereof. The exhaust passageway may be formed by a sleeve insert which also can be selectively changed to vary the diameter of the exhaust passageway and pump performance. A compressed air-actuated pinch valve is positioned in the exhaust passage. The pinch valve has an internal flexible sleeve, preferably constructed of a corrosion resistant non-degradable elastomeric or polymeric material. An EPDM rubber is particularly suitable for use as a flexible sleeve material in the pinch valve. In a first open position, the flexible sleeve assumes a diameter preferably at least as great as the diameter of the exhaust passage, permitting unrestricted air flow from the nozzle to pass through the exhaust passageway and through the flexible sleeve to exhaust outwardly therefrom. In a closed position, the flexible sleeve of the pinch valve shuts off the exhaust air flow through the exhaust passageway and forces the nozzle air stream to enter the pump body. Control means, which may be in the form of a pneumatic or electronic timing circuit, preferably utilizing opto-electronic liquid level sensors, directs compressed air flow to the pinch valve to selectively open and close the flexible sleeve therein. In use, when the pinch valve is in an open position, a high velocity air stream is emitted from the nozzle and passes through the spaced exhaust passageway to cause a vacuum condition to exist within the pump body and thereby draw a liquid through the inlet orifice into the tank body. After a certain level is sensed in the tank, or after a given time period, the control means through appropriate circuitry introduces air to the pinch valve, causing the flexible sleeve to assume the closed position. When the pinch valve closes, the high velocity air stream emitted from the nozzle is diverted from the exhaust passage and enters the pump body, causing a pressurized condition to exist therein. The high pressure condition causes the immediate evacuation of liquid through the outlet orifice of the pump body. Valve means are also associated with the compressed air inlet to the venturi nozzle to permit independent variable adjustment of air flow rates to the nozzle, both in the vacuum pump and in the pressurized pump down cycles. Thus, an infinite range of flow rates is possible, while conserving air usage and energy costs.

The present invention also provides a method of pumping corrosive and erosive liquids, abrasive slurries and the like, the method comprising the steps of: providing a fluid-tight pump body having respective inlet and outlet orifices communicating therewith and one-way check valve means associated with each of the orifices; providing nozzle means having an axial bore positioned in an upper portion of the tank body, the nozzle means having an inlet end adapted to be placed in communication with a source of pressurized air and having an outlet end communicating with the tank body and in spaced relationship to a first end of an axially spaced exhaust passage; providing a compressed air-actuated valve means having a flexible elastomeric or polymeric sleeve therein which, in an opened position, assumes a diameter at least as great as a diameter of said exhaust passage, to permit unrestricted air flow therethrough and, in a closed position, to shut off air flow therethrough; providing control means to emit compressed air at selected flow rates to said valve. In use, when the pinch valve is in an open position, a high velocity air stream is emitted from the nozzle means to cause a vacuum condition to exist within the pump body and thereby draw liquid through the inlet orifice into the pump body at a predetermined rate. When the pinch valve is selectively moved to the closed position, a high velocity air stream of selected magnitude from the nozzle enters the pump body causing a pressurized condition to exist at a predetermined flow rate, forcing the liquid through the outlet orifice thereof.

Hence, it is readily appreciated that the only moving part in the pump of the present invention exposed to harsh chemicals is the flexible sleeve of the pinch valve. The flexible sleeve is constructed of an elastomeric or polymeric material which is resistant to the corrosive, erosive and abrasive characteristics of any entrained liquid or solid particulate material which passes therethrough. Long life, dependable operation and low maintenance thus result from the pump of the invention. These, as well as other advantages, will become clear when reference is taken to the attached drawings when explained in the following detailed description.

IN THE DRAWINGS

DETAILED DESCRIPTION OF THE INVENTION

Figure 1:
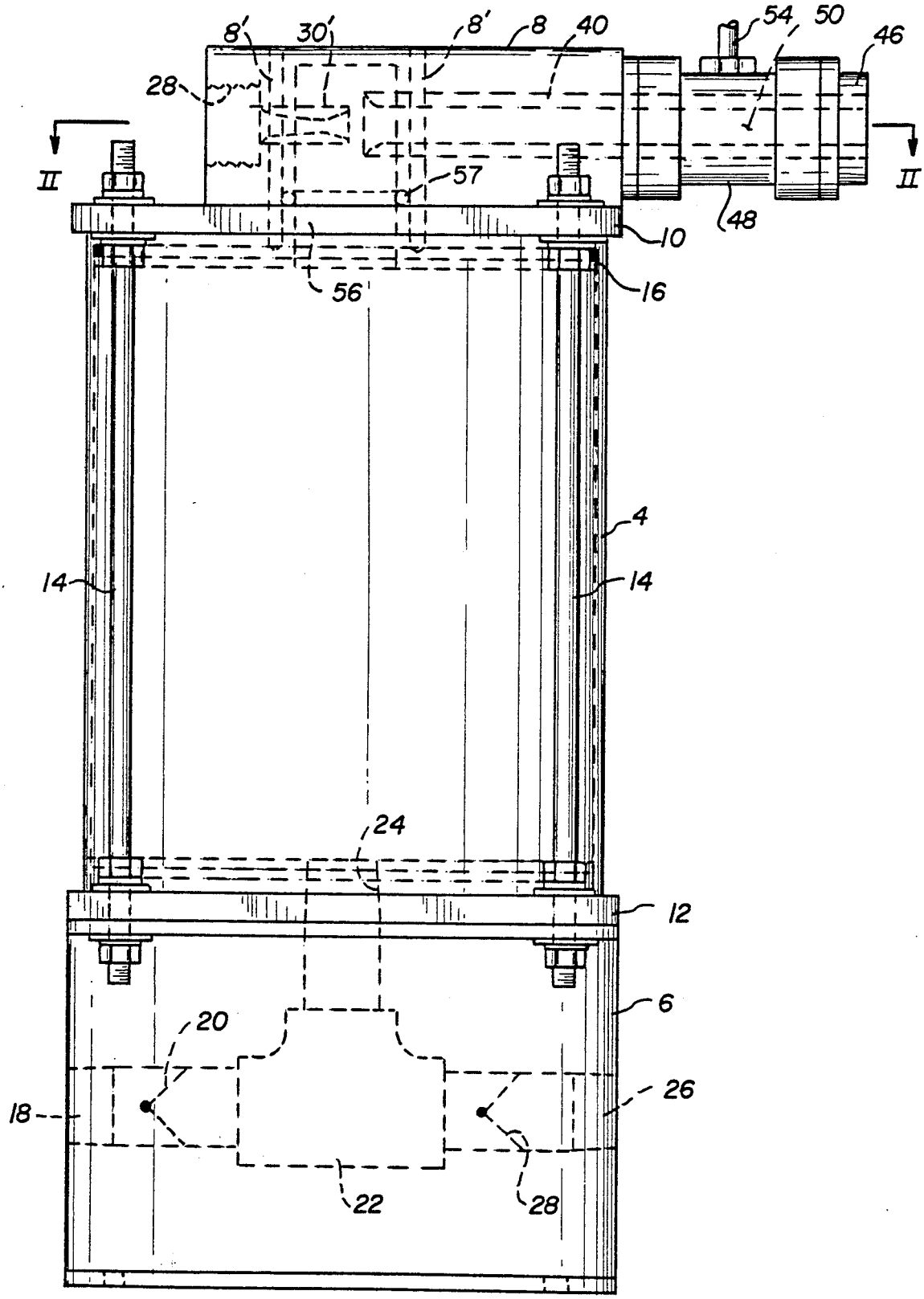
FIG. 1 is a side elevation view of the pump of the present invention.

Referring now to the drawings, the pump of the present invention, generally designated 2, includes a fluid-tight pump body 4 and a lower base portion 6 which rests on a supporting surface. A housing or venturi block 8 located at the top of the fluid-tight pump body 4 contains the necessary components for generating the alternating vacuum and pressurized conditions required for the pumping action. The pump body 4 is conveniently formed by a cylindrical shell sealed at its ends by an upper plate 10 and a lower plate 12. The plates 10 and 12 are tightly drawn together by a plurality of tie bolts 14. An 0-ring sealing gasket 16 may be employed at one or both ends of the pump body to insure leak-free operation so as to improve the efficiency of the vacuum and pressure cycles of the pump. The pump body 4 is preferably constructed of a filament-wound, glass reinforced epoxy material.

The filament-wound cylinder forming the sidewall of the pump body 4 exhibits a high hoop strength while being relatively lightweight. A filament-wound structure, having a thickness of about 3/16", has a burst pressure ratio exceeding 15 to 1. The transparency provided by the epoxy structure allows visual observation of the pumping action within the pump body 4 to permit immediate detection of any malfunctions and also to provide a convenient visual sighting method for presetting any desired liquid pumping level.

The manifold, or base 6, includes an inlet orifice 18 which is adapted to be placed in communication with the liquid to be pumped. The inlet orifice is fitted with a one-way check valve 20, of conventional construction, which permits liquid to flow only in the inlet direction through a T-fitting 22 and through a conduit 24, which communicates with the interior of the fluid-tight pump body 4 at the bottom thereof. An outlet orifice 26 also is fitted with a one-way check valve 28, which permits the flow of liquid therethrough only in an outlet direction. The outlet orifice 26 communicates with the conduit 24 by way of the fitting 22. Thus, liquid or flowable slurry is permitted to flow into the interior of the pump body 4 by way of inlet orifice 18 and is evacuated therefrom through outlet 26, while the check valves 20 and 28 prevent flow through the respective orifices in a reverse direction.

The housing or venturi block 8 at the upper portion of the pump body is preferably constructed of a non-corrosive material, such as, plastic, aluminum, stainless steel or the like. A plastic material offers the advantages of durability, corrosion resistance and light weight, while also being relatively inexpensive. The block 8 may be a separate element, or it may be integrally molded or otherwise joined with the upper plate 10 of the tank body. Elongated, threaded fasteners 8' are employed to secure the block 8 to the plate 10 if these elements are provided as separate components. A venturi nozzle 30 is removably inserted within a bore 32 formed in the block 8. The nozzle 30 has a flanged inlet end 34, an axial bore 36 and an outlet end 38. The nozzle 36 has a bore preferably formed in a converging-/diverging shape to produce a supersonic air stream at the exit end 38 thereof. The nozzle 30 is preferably constructed of a corrosion resistant polymeric material which may be integrally molded into venturi block 8 or may be a separate, removable insert. Nozzle 30 may be removably positioned within the inlet bore 32 so as to permit easy nozzle changeover to selectively alter the pump performance. For example, a typical nozzle bore of a nominal dimension less than 0.250 inches, for example, may be employed for general pumping applications. If additional air flow and higher vacuums are required for greater suction head, a nozzle having a greater bore diameter can be easily inserted into the bore 32 after the smaller diameter nozzle has been withdrawn therefrom. In this manner, the pump 2 is easily modified to operate under a variety of pumping conditions by merely changing the nozzle bore diameter size.

A source for generating pressurized air, such as an air compressor, (not shown) communicates with the inlet bore 32 by a flexible hose or the like to supply compressed air thereto within conventional ranges. An exhaust passageway 40 is positioned in the venturi block 8 and is coaxially aligned with the bore of the nozzle 30. An inlet end 42 of the passageway 40 is positioned in spaced-apart relationship relative to the outlet end 38 of the nozzle 30. An opening 56 is formed in the venturi block 8 and upper plate 10 to permit communication between the nozzle 30 and interior of the pump body 4. An appropriate O-ring 57 is employed around the opening 56 at the interface between the block 8 and plate 10 to provide a fluid tight seal therebetween. The inlet end of passageway 40 also preferably has a tapered edge 42 leading to a straight passage 41 having a diameter at least as great as the bore diameter at the outlet end of the nozzle 30 so as to prevent shock waves and undue air turbulence in the exhaust passageway. The exhaust passage 40 also contains a diverging tail section 44, which communicates with the bore of an air exhaust fitting 46, which, in turn, is connected to a suitable exhaust conduit (not shown). The outlet fitting 46 and conduit connected thereto may communicate with a suitable vapor recovery system.

Figure 2:
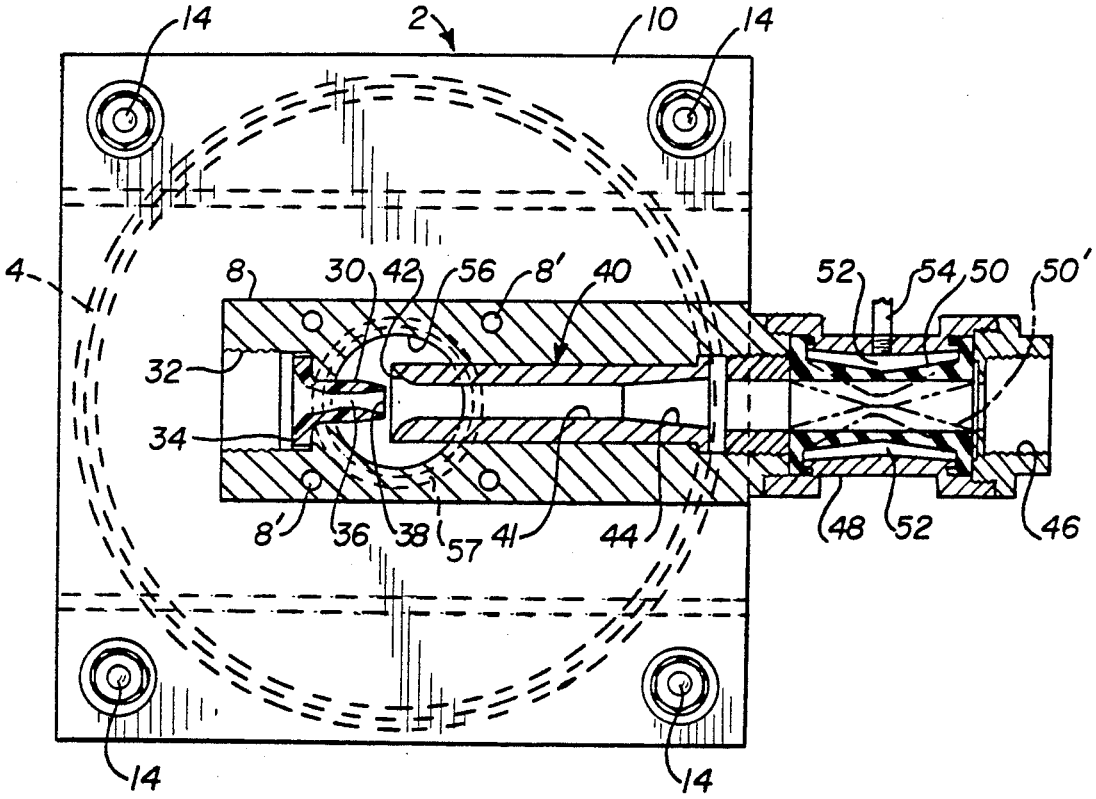
FIG. 2 is a top plan sectional view taken along line II—II of FIG. 1.

As shown in FIG. 2, the exhaust passageway 40 is formed by an insertable sleeve element which has a cylindrical shape with an axial bore 41 and 44 to permit the high velocity air stream from the venturi nozzle 30 to exit therethrough. The exhaust passageway sleeve 40 can easily be removed from block 8 and replaced by a sleeve having a different size bore 41 so as to instantly modify the pump performance and to match an increase in the nozzle 30 size, for example. A pinch-valve assembly 48, having a tubular, flexible sleeve 50 is positioned between the exhaust passageway 40 and the exhaust fitting 46. An annular space 52 is provided between the flexible sleeve 50 and the inner rigid wall of the pinch valve 48, which receives compressed air from conduit 54. The conduit 54 communicates with space 52 of the pinch valve and is attached to a suitable supply of compressed air. When compressed air is selectively introduced through the conduit 54 to the annular space 52, the flexible sleeve 50 is expanded inwardly to close-off air flow within the bore of the passageway 40, as shown by the phantom lines and indicated by the reference numeral 50', in FIG. 2. The flexible sleeve 50 is preferably constructed of a natural or synthetic elastomer or flexible polymeric material. Sleeve 50 is most preferably made from EPDM rubber which is found to be resistant to chemical attack.

In operation, high pressure air is introduced to the bore 32 and passes through the nozzle 30. The nozzle, due to its preferred converging/diverging configuration, accelerates the air to very high velocities, preferably in the supersonic domain. The high velocity air stream exits the nozzle and passes through the exhaust passage 40 to exit the outlet 46. The diameter of the flexible sleeve 50 in the open position is preferably at least as great as the diameter of the passageway 40 so as to provide unrestricted flow for the exhausting high velocity air stream whereby no back pressure and attendant shock waves are present in the system. Under known principles, as the high velocity air stream passes above the opening 56 in the venturi block 8 and in upper plate 10, a vacuum condition is created within the interior of the fluid tight pump body 4. When this vacuum condition exists, liquid is drawn into the pump body 4 by way of the inlet orifice 18 and the connected conduit 24. When a given height of liquid is reached within the pump body 4, compressed air is selectively introduced into the annular space 52 of the pinch valve 48 by way of a conduit 54. The pressurized air within space 52 causes the flexible sleeve 50 to expand inwardly to assume the closed position 50'. In the closed position 50', the flexible sleeve causes the high velocity air stream emitted from nozzle 30 to be diverted downwardly through opening 56 in the venturi block 8 and upper plate 10 to create a pressurized condition within the pump body 4. Thus, in the pressurized pump-down mode, liquid is forced out of the pump body through the conduit 24 and out of the outlet orifice 26 to a suitable receiving reservoir, or the like.

The compressed air supplied to conduit 54 of the pinch valve device 48 is selectively controlled by way of control means which may operate in one of several presently preferred modes. Presently preferred control means include a timing circuit, pneumatic, electric or electro-pneumatic or solid state liquid level sensors. When the liquid reaches an upper level within the pump body, a timing circuit of known pneumatic design schematically identified as "T" and element 83 in FIG. 3 signals valve V to cause pressurized air to close the pinch valve 48 and thus create a positive pump-down pressure in the pump body. After a predetermined period of time, the timer circuit 83 signals valve V to shut off the air flow through conduit 54, which immediately causes the high velocity air stream from nozzle 30 to open the pinch valve and freely flow through the exhaust passageway 40. The re-directed air stream instantaneously creates a vacuum condition within the pump body 4 whereby liquid is again drawn into the tank body. A typical timer control circuit 83 continues to cycle in this fashion in alternating, timed pressurized and vacuum cycles of any preselected duration. The cycle time is easily varied by adjustment of the conventional pneumatic, electric or electro-pneumatic timer in known fashion. The pneumatic, electric or electro-pneumatic timer 83 communicates with valve element 80 shown in the pneumatic circuit of FIG. 3 whose functioning will be explained in greater detail below.

Figure 3:
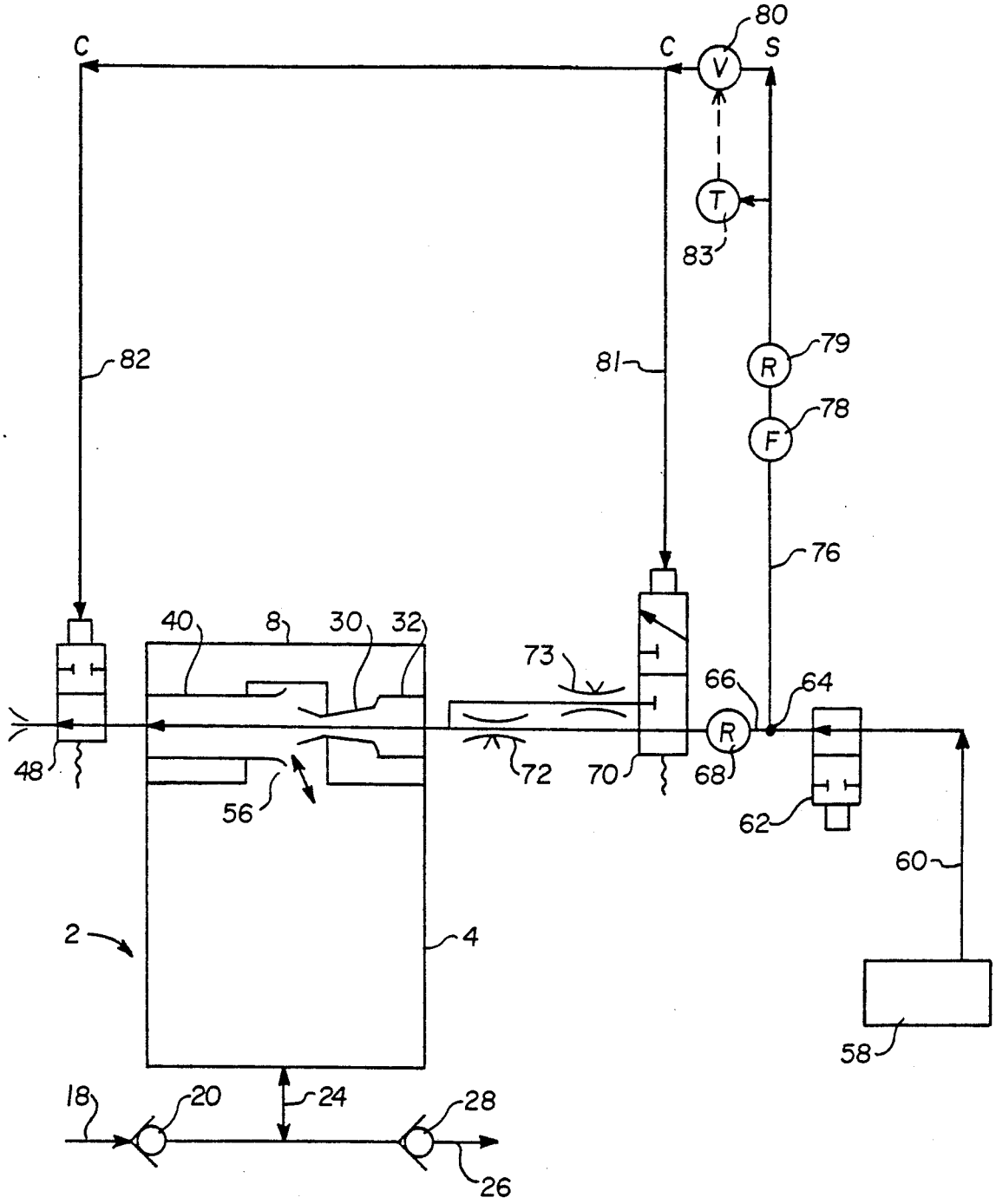
FIG. 3 is a schematic diagram of a presently preferred pneumatic valve arrangement for use in connection with the present invention.
Figure 4:
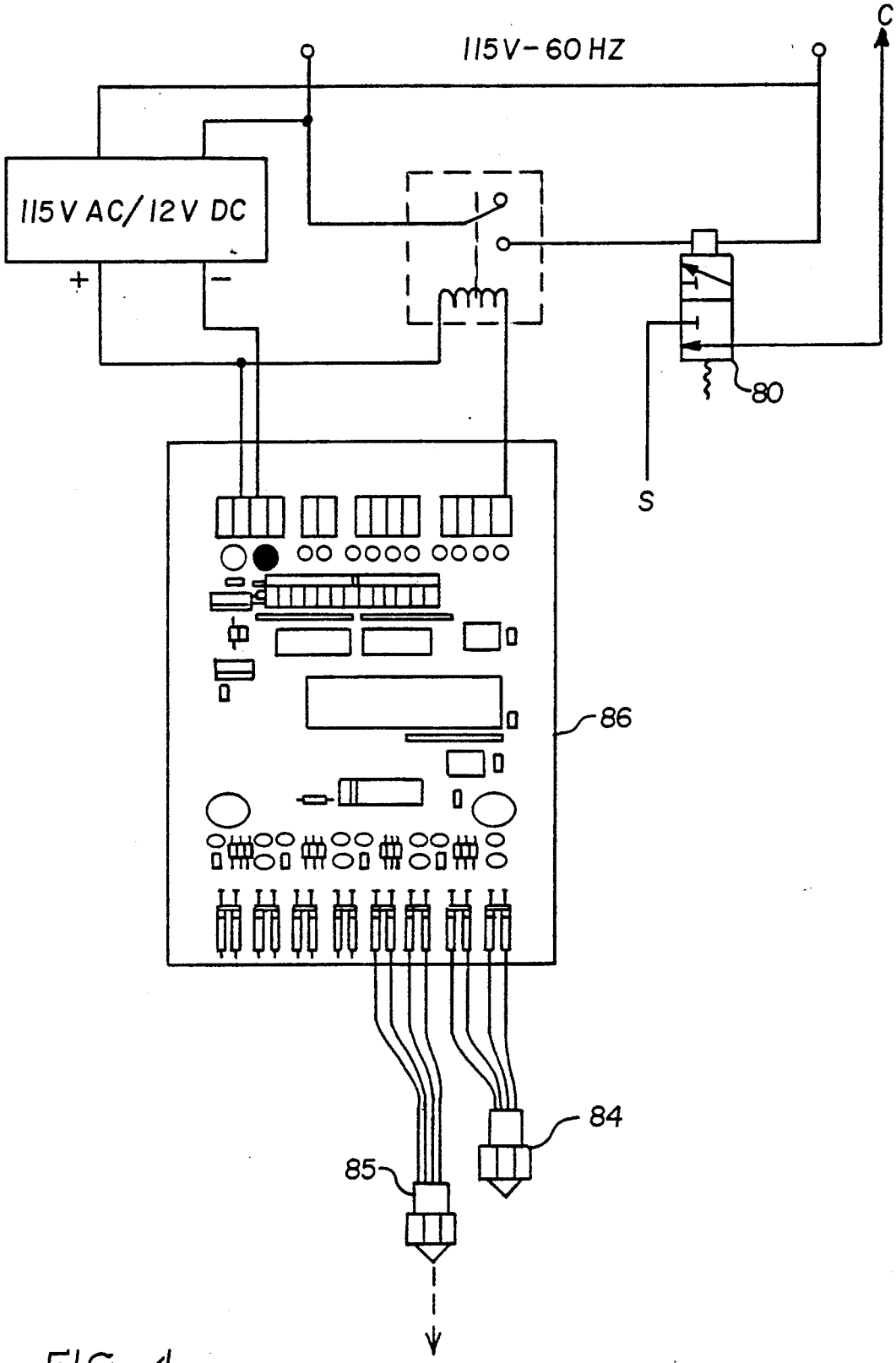
FIG. 4 is a schematic diagram of a presently preferred embodiment of a control circuit for use with the present invention.

A presently preferred pneumatic circuit and control means is shown in FIG. 4 which is particularly suitable for use when the above-described timing circuit flow control is not practical, such as when the liquid supply or demand flow rates vary over time. FIG. 4 depicts a presently preferred flow control circuit scheme employing two or more liquid level sensors 84 and 85, interfaced with a low power micro processor board 86 which controls the operation of an array of pneumatic valves which direct the air flow to and from the pump 2. The air flow circuit is shown schematically in FIG. 3 which is suitable for use in both a timing control or in the liquid sensor control of FIG. 4.

Compressed air from a source such as an air compressor 58 is directed by conduit 60 to an inlet control valve 62. Valve 62 is preferably a two-way, normally open, air piloted or electrically actuated solenoid or manually operated valve. When valve 62 is closed, no pressurized operating air from the compressor 58 can reach the downstream pneumatic valve controls or the pump 2. When valve 62 is opened, air passes through the valve 62 to a "T"-fitting 64 and thence to an air pressure regulator 68. Air of desired pressure then passes from the pressure regulator 68 to a three-way normally open, air piloted pneumatic valve 70. In the normally open position, that is, when the pump is in the pump-in or vacuum mode, the valve 70 emits pressurized air to a variable flow control valve 72 which then directs a stream of pressurized air of regulated flow to the inlet bore of the venturi nozzle 30. By adjustment of control valve 72, the flow rate of air entering nozzle 30 is selectively regulated to control the pump-in rate. In the vacuum, pump-in mode of operation, the pinch valve 48 is in an open position, as previously described. In FIG. 3, the pinch valve 48 is schematically represented as a two-way normally open air piloted pneumatic valve.

In order to transmit pilot air to selectively shift the pneumatic valve 70 and close pinch valve 48, a branch conduit 76 is provided at the T-joint 64. Air in the conduit 76 flows through a filter 78 to a pressure regulator 79 to a main control valve, shown schematically in FIG. 3 as valve "V" and in FIG. 4 as a normally open, electrically or pneumatically actuated three-way valve and identified by reference numeral 80. Valve 80, when selectively actuated or shifted by the sensing and control circuitry depicted in FIG. 4, the functioning of which will be explained in greater detail hereinafter, directs pilot air to simultaneously shift valve 70 and close pinch valve 48 through conduits 81 and 82, respectively. When the pinch valve 48 is closed, the pump 2 is transformed into the pump-out or pressurized cycle of operation. When valve 70 shifts, incoming air is shifted to a second variable flow control valve 73 which directs a pre-selected flow rate of air to the nozzle 30 and tank body 4 for pump-down purposes. Hence, a unique feature of the present invention resides in the use of first and second variable flow control valves 72 and 73, respectively, in conjunction with control valve 70 which permits independent adjustment of the air flow rates in the pump-in (vacuum) and pump-out (pressurized) cycles. This feature permits selective adjustment of the pump-in and pump-out cycles to as low as one gallon per minute. By varying the air supply for the two cycles, the pump 2 easily achieves the same flow rates as prior conventional air pumps, but with a minimum of air consumption. Naturally, plant energy costs are lowered and a savings is realized by the end user when compressed air consumption is minimized.

The operation of the main control valve 80 is best understood by referring to FIG. 4. In this one presently preferred embodiment, the pumping cycle is controlled by a pair of liquid level sensors 84 and 85, preferably solid state, opto-electronic liquid sensors. Upper liquid level sensor 84 and lower liquid level sensor 85 are mounted within the pump body 4 at spaced-apart locations near the top and bottom, respectively, thereof. The sensors may be mounted on suitable adjustable members to permit vertical movement of the sensors within the translucent pump body 4 so that the liquid levels of any desired value can be visually selected. Opto-electronic liquid sensors 84 and 85 are static devices which use reflected light to sense the presence or absence of liquids at discrete levels in closed vessels. The devices sense the presence of liquid in a vessel and perform well in clear or turbid, thin or viscous liquids. The sensors are inert to virtually all liquids, including strong acids and caustics. They are intrinsically safe and explosion proof. Power is applied to an opto-electronic interface which couples directly to the outer end of the sensor and contains a miniature light source and a photo-transistor for each discrete level to be monitored. When power is applied to the sensor devices, light is sent into each of the rods. The photo-transistors are arranged to be sensitive only to the reflected light. The result is that the transistors will either be "On" or "Off" depending upon the condition in the tank at that level.

As previously explained, during the pump-in cycle, with both sensors 84, 85 (high and low level) being dry, the valve coil of valve 80 de-energizes to start the vacuum pump-in cycle. Air enters through the two-way normally open valve 62, flows through the three-way normally open pilot-operated valve 70 to the variable control valve 72. The pinch valve 48 is shown in FIG. 3 as a two-way, normally open valve, and is maintained in an open position when the pump is in the vacuum mode. Simultaneously, air flows through the venturi block 8 and nozzle 30, creating a suction within the pump body 4, which opens the intake check valve 20 while closing the discharge check valve 28. This creates a negative pressure or vacuum condition within the pump body 4, exhausting air through the pinch valve 48 while pulling in liquid through the intake check valve and into the cylindrical confines of body 4. When the liquid reaches the high level sensor 84, the sensor immediately senses a "wet" condition and emits a signal back to a so-called "smart board" 86 (a low-power microprocessor) while stopping the liquid from rising beyond the prism in high level sensor 84. Simultaneously, the three-way pilot-operated valve 80 signals the pinch valve 48 to close; thus, the vacuum pump-out cycle ends and the pressurized pump-out cycle begins.

In order to start the pump-out cycle, both high and low level sensors 84 and 85, respectively, are wet which energizes the valve coil in main valve 80 via smart board 86 to start the pressurized cycle. With the pinch valve 48 closed, air flows through the three-way valve 70 through the venturi block 8 and into the pump body 4, to open the discharge check valve 28 while maintaining the intake check valve 20 in a closed position, thus pushing the liquid through the discharge check valve. When the liquid level reaches the prism in the low level sensor 85, a signal is emitted back to the smart board 86 which stops the liquid from discharging below the prism of sensor 85. Simultaneously, the main three-way pilot-operated valve 80 signals the pinch valve to open, thus the pressurized pump-out cycle ends and a new vacuum pump-in cycle begins.

The flow control components shown in the drawings may be mounted compactly on the top plate 10 of the pump adjacent to the venturi block 8 or they may be remotely located away from the pump body 4, if desired.

I claim:

1. A method of pumping corrosive and erosive liquids, abrasive slurries and the like, the method comprising:

providing a fluid-tight pump body having respective inlet and outlet orifices communicating therewith in a lower portion of the pump body and one-way check valve means associated with each of said orifices;

providing nozzle means having an axial bore positioned in an upper portion of said pump body said nozzle means having an inlet end adapted to be placed in communication with a source of pressurized air and having an outlet end communicating with said pump body and in spaced relationship to a first end of an axially aligned exhaust passage;

providing pinch valve means having an elastomeric sleeve in said exhaust passage to permit air flow through said exhaust passage when in an open position and to shut off air flow therethrough when in a closed position; and providing control means to selectively open and close said pinch valve means;

introducing a flow of pressurized air through said nozzle means and said exhaust passage to create a vacuum condition within said pump body when said pinch valve means is in an open position and to create a pressurized condition within said pump body when said pinch valve means is in a closed position;

regulating the flow of pressurized air to a first flow rate valve through the nozzle means when the vacuum condition exists within the pump body; and regulating the flow of pressurized air to a second flow rate valve through the nozzle means when the pressurized condition exists within the pump body.

2. A pump apparatus suitable for pumping corrosive and erosive liquids, abrasive slurries and the like, said apparatus comprising:

a fluid-tight pump body having respective inlet and outlet orifices communicating therewith in a lower portion of the tank body and one-way check valve means associated with each of said orifices;

nozzle means having an axial bore positioned in an upper portion of said tank body said nozzle means having an inlet end adapted to be placed in communication with a source of pressurized air and having an outlet end communicating with tank body and in spaced relationship to a first end of an axially aligned exhaust passage;

valve means in said exhaust passage to permit air flow through said exhaust passage when in an open position to create a vacuum condition within said pump body and to shut off air flow therethrough to create a pressurized condition within said pump body when in a closed position;

pneumatically actuated flow control circuit means to selectively open and close said valve means whereby said pump alternately cycles between a vacuum condition and a pressurized condition within said tank body; and a first variable flow control valve means for selectively adjusting a flow rate of pressurized air entering the nozzle means when the pump is in the vacuum condition and a second variable flow control valve means for selectively adjusting a flow rate of pressurized air entering the nozzle means when the pump is in the pressurized condition.

3. The apparatus of claim 2 wherein the signal generating means includes opto-electronic liquid sensing means positioned within the pump body for sensing an upper liquid level and a lower liquid level therein.

4. The apparatus of claim 2 wherein the signal generating means included timing means selected from the group consisting of pneumatic, electrical and electro-pneumatic timing devices.

5. The apparatus of claim 2 wherein the pneumatically actuated flow control circuit means includes an inlet control valve adapted to be placed into communication with the source of compressed air to permit selective access to said compressed air source;

pressure regulator means communicating with said inlet control valve;

a first three-way, normally open, air-piloted pneumatic valve communicating with the pressure regulator means adapted to receive pressure regulated air therefrom and to alternatingly supply said air to one of said first or second variable flow control valve means upon air piloted shifting of said three-way pneumatic valve;

a second pressure regulator means communicating with said inlet control valve;

a second, normally open, three-way valve communicating with said second pressure regulator means and responsive to signal generating means with shift said second valve from a first to a second position, said second three-way valve also placed in communication with said first three-way valve and said valve means in said exhaust passageway, whereby when said second three-way valve is in the first position, said first three-way valve is maintained in a position to supply pressurized air to said first variable flow control valve and said valve means in the exhaust passage is maintained in the open position to create the vacuum condition in said pump body, and when said second three-way valve is shifted to the second position by said signal generating means, said first three-way valve is shifted to supply pressurized air to said second variable flow control valve and simultaneously close said valve means in the exhaust passage to create the pressurized condition in the pump body.

6. The apparatus of claim 5 wherein the valve means in the exhaust passage is a pneumatically actuated pinch valve.

7. A pump apparatus suitable for pumping corrosive and erosive liquids, abrasive slurries and the like, said apparatus comprising:

a fluid-tight pump body having respective inlet and outlet orifices communicating therewith in a lower portion of the pump body and one-way check valve means associated with each of said orifices;

nozzle means having an axial bore positioned in an upper portion of said pump body, said nozzle means having an inlet and adapted to be placed in communication with a source of pressurized air and having an outlet end in communication with said pump body and in spaced relationship to a first end of an axially aligned exhaust passage means;

a first variable flow control valve means for selectively adjusting a flow rate of air entering the nozzle means when the pump is in a vacuum condition;

a second variable flow control valve means for selectively adjusting a flow rate of air entering the nozzle means when the pump is in a pressurized condition;

a compressed air actuated pinch valve having an internal, flexible sleeve of an elastomeric material positioned in communication with a second end of said exhaust passage means, said pinch valve also including a rigid wall surrounding said flexible sleeve and spaced therefrom to define an annular space around said flexible sleeve, said annular space adapted to be placed in communication with a source of compressed air, and selectively collapsed when the compressed air enters said annular space to move said flexible sleeve to a closed position and when said source of compressed air is selectively shut off said flexible sleeve is adapted to move to an open position, said flexible sleeve when in an open position assumes a diameter at least as great as a diameter of said exhaust passage means permitting exhaust air flow therethrough and when in a closed position shuts off the exhaust air flow through said exhaust passage means; and control means for introducing compressed air to the annular space surrounding the flexible sleeve of said pinch valve to selectively open and close the flexible sleeve of said pinch valve whereby in use when the pinch valve is in an open position, a high velocity air stream is emitted from said nozzle means through said spaced exhaust passage means to cause a vacuum to exist within the pump body and thereby draw a liquid through the inlet orifice into said pump body and when said pinch valve is selectively moved to the closed position, the high velocity air stream from the nozzle means enters the pump body to create a pressurized condition to exist, causing the liquid therein to exit through the outlet orifice thereof.

8. The apparatus of claim 7 wherein the control means comprises a pneumatic circuit means actuated by liquid level sensor means positioned within the tank body.

9. The apparatus of claim 7 wherein the control means comprises a pneumatic circuit means actuated by timer means.

10. The apparatus of claim 7 wherein the pump body is cylindrical in shape and includes a sidewall portion constructed of a glass reinforced, filament-wound composite material.

11. The apparatus of claim 7 wherein the removable flanged nozzle insert has a converging/diverging bore shape and is constructed of a polymeric material.

12. The apparatus of claim 7 wherein the nozzle means comprises a nozzle insert, removably positioned within the upper portion of said pump body to permit the selective use of nozzle inserts having various sized bore diameters whereby vacuum and pressure conditions existing within the pump body may be selectively obtained by use of a predetermined nozzle bore size.

13. The apparatus of claim 12 wherein the exhaust passage means is in the form of a cylindrically-shaped exhaust sleeve member removably inserted within an upper portion of the pump body to permit the selective use of exhaust sleeve members having various sized bore diameters therein.

14. The apparatus of claim 7 wherein the nozzle means, exhaust passage means and flexible sleeve of the pinch valve are constructed of corrosion resistant materials.

15. The apparatus of claim 14 wherein the flexible sleeve of the pinch valve is constructed of an EPDM rubber material.

* * * * *